US007622237B2

(12) United States Patent
Banhazl

(10) Patent No.: US 7,622,237 B2
(45) Date of Patent: Nov. 24, 2009

(54) SYSTEM, APPARATUS, AND METHOD FOR THE PERMANENT TRANSFER OF IMAGES ONTO GLOSSY SURFACES

(76) Inventor: Terrie Banhazl, 18 Brook Trail Rd., Wayland, MA (US) 01778

( * ) Notice: Subject to any disclaimer, the term of this patent is extended or adjusted under 35 U.S.C. 154(b) by 548 days.

(21) Appl. No.: 11/527,270

(22) Filed: Sep. 26, 2006

(65) Prior Publication Data

US 2007/0081838 A1 Apr. 12, 2007

Related U.S. Application Data

(60) Provisional application No. 60/721,891, filed on Sep. 29, 2005.

(51) Int. Cl.
*G03G 13/16* (2006.01)
*G03G 13/20* (2006.01)
*G03G 13/22* (2006.01)

(52) U.S. Cl. ..... 430/124.1; 430/124.13; 430/124.14; 430/124.5; 430/124.51

(58) Field of Classification Search ..... 430/124.1, 430/124.13, 124.14, 124.5, 124.51
See application file for complete search history.

(56) References Cited

U.S. PATENT DOCUMENTS

| | | | | |
|---|---|---|---|---|
| 5,678,133 | A * | 10/1997 | Siegel | 399/67 |
| 5,948,471 | A | 9/1999 | Zimmer | |
| 5,972,548 | A | 10/1999 | Landa et al. | |
| 6,110,632 | A | 8/2000 | Dunford et al. | |
| 6,487,386 | B1 | 11/2002 | Zimmer et al. | |
| 6,624,118 | B2 * | 9/2003 | Tang et al. | 503/227 |
| 6,674,978 | B1 * | 1/2004 | Suzuki et al. | 399/67 |
| 6,694,885 | B2 | 2/2004 | Geddes et al. | |
| 6,814,088 | B2 * | 11/2004 | Barnabas et al. | 134/25.2 |
| 2003/0013027 | A1 | 1/2003 | Wallace | |

FOREIGN PATENT DOCUMENTS

GB 2151189 7/1985

OTHER PUBLICATIONS

Website: The International Museum of Print on Clay / Techniques Page www.printandclay.net/printandclay/techniquestt.htm.

* cited by examiner

*Primary Examiner*—Hoa V Le

(57) ABSTRACT

The present invention relates to a method for permanently affixing high-quality images onto glossy substrates. Using off-the-shelf supplies and equipment, a user may print or copy any image to an imaging device utilizing toner with iron oxide to imprint the image onto a film covered transfer agent. The transfer agent is moistened, separated and the image is applied to a glossy substrate without requiring an additional cover coat. It is then fired in a kiln where the surface of the glossy substrate softens and the film of the transfer agent melts or evaporates away leaving the iron oxide pigmented image permanently fused to the glossy substrate.

9 Claims, 2 Drawing Sheets

SYSTEM, APPARATUS, AND METHOD FOR THE PERMANENT TRANSFER OF IMAGES ONTO GLOSSY SURFACES

CROSS-REFERENCE TO RELATED APPLICATIONS

Provisional Patent No. 60/721,891, Sep. 29, 2005

STATEMENT RE: FEDERALLY SPONSORED RESEARCH/DEVELOPMENT (Not Applicable)

BACKGROUND OF THE INVENTION

The present invention relates to systems and methods for transferring high quality two-dimensional images permanently onto kiln fire able glossy substrates by printing on a film covered transfer agent using toner containing iron oxide.

The ability to easily, economically and safely apply one of a kind high quality photographic images onto a transfer agent and permanently affix these images on to functional kiln fire able ceramic or glass surfaces without specialty manufacturing equipment, potentially toxic cover-coats or specialized training, has heretofore been impossible.

Existing methods for permanently affixing images including print or photographs onto ceramic surfaces require extensive time, skilled labor and expensive equipment. (Zimmer U.S. Pat. No. 6,487,386 2002). The most common method requires an elaborate multi-step silkscreen process using solvent based ceramic inks or glazes. Photographs and other detailed images using these silk screen processes are generally poor in quality.

Another modern method called thermal transfer printing requires expensive specialized machinery containing ceramic colorant infused ribbons. (Geddes U.S. Pat. No. 6,694,885 2004)

Recently some manufacturers have begun using high-end color ink jet, laser printers, and photocopiers with retrofitted ceramic pigments replacing the machine's standard inks or toners. (Landa U.S. Pat. No. 5,972,548 1999) These digital imaging techniques require a high degree of expertise and are extremely expensive and are only practical for printing professionals producing medium-to-large runs. These processes require multiple production steps and specialty equipment which wouldn't fit into a small studio, school classroom or home office. None of these methods are a cost effective way for a home hobbyist, ceramic artist or student to make custom (one-off) pieces.

In all of these prior processes, the amount of ink, toner or glaze that is deposited onto the transfer agent must be carefully monitored for evenness and thickness of deposit. In the color inkjet, laser printer or photocopier processes default settings on the fusing heat rollers must be adjusted depending on the thickness of the toner deposit. And in some cases the transfer agent must be pulled from the machine before entering the fusing heat rollers (Zimmer U.S. Pat. No. 5,948,471 1999)

In all currently used image transfer methods, a printed image must make direct contact with the ceramic surface. In order to achieve direct contact, images are either printed directly onto the substrate using silk screens or colorant infused printing ribbons, or the image is applied to a traditional one layer transfer agent with cover-coats of solvent based lacquers, varnishes, or laminations applied over the image. (Dunford U.S. Pat. No. 6,110,632 2000)(Wallace US2003013027 2003) (Geddes U.S. Pat. No. 6,694,885 2004)

The cover-coated image is then moistened so that it may be separated intact from the transfer agent and then adhered directly to the ceramic surface before firing. Proper application of cover-coats requires a high degree of skill and precautions must be taken when handling potentially toxic solvents.

Some prior transfer techniques allow images to be printed onto pre-coated transfer agents. But, in order to make the necessary direct contact with the ceramic surface, the image must be printed as a mirror image and flipped over as a whole before adhering to the substrate. These types of transfer gymnastics are tricky and time consuming.

With the advent of inexpensive mass marketed, "off-the-shelf" black and white laser printers and copiers equipped with iron oxide containing toners, studio artists discovered that printed images containing iron oxide toner could be printed onto fire able substrates and fired in a kiln resulting in an iron oxide pigmented permanent image. But as with all prior image transfer techniques, it is believed that iron oxide toner images have to make direct contact with the substrate. To accomplish this most require the use of a solvent based lacquer cover coat over a traditional one layer transfer paper. (Blow GB2151189 1984) This technique resulted in inconsistent image quality and difficulty in handling.

Some artists use a risky technique of opening a laser printer and pulling the toner printed image out before it has run through the hot fusing rollers. The powdery toner is then pressed into unglazed damp clay. The clay with toner image pressed on is then dried and fired. If ceramic glazes are applied over this type of transfer, the image will corrupt, so the resulting fired substrate must remain unglazed thus porous. Porous ceramic surfaces are not fully functional since they can't hold liquids. (www.printandclay.net/printandclay/techniquestt.htm)

Prior to this invention the ability to safely, easily and permanently affix high quality images onto functional kiln fire able surfaces was not accessible to the home hobbyist, artist, ceramics studio, school, or small to medium sized custom ceramics manufacturer due to the expense, time, space and technical skills needed. The potential toxicity of all currently used solvent based cover-coats, and the danger of opening hot laser printers to pull out un-fused prints made these prior methods unsafe for the inexperienced handler.

SUMMARY OF THE INVENTION

In embodiments of the present invention, an iron oxide containing toner, standard in many inexpensive mass marketed "off-the-shelf" laser printers and photocopiers, is used to print any image or photograph onto a transfer agent, in this case a film covered water slide decal paper. This commercially available pre-coated decal paper is commonly used to make unfired decals for hobby models and other low temperature arts and craft applications. In this invention, as in a typical unfired decal application, an image is printed on top of the film layer and then the decal paper is dipped in water where the paper bottom sheet separates and is discarded. The film layer with the image printed on top is adhered to a previously glazed ceramic surface in the conventional way. But unlike the unfired decal application method, in this invention the glazed ceramic piece with image adhered is then fired in a kiln to permanently affix the image.

This invention uses a counterintuitive application of a transfer material previously used exclusively for non kiln fired decal applications. Because the printed image is applied with a layer of film sandwiched between the image and the substrate it is counterintuitive to believe that the image would survive the high firing temperatures of a kiln without being corrupted during the melting phase of the film. In this invention it has been discovered that when an iron oxide containing image is printed on the film layer of this type of transfer paper, adhered to a glazed ceramic surface, and subjected to the firing temperatures of a kiln, the residual adhesive, the polymer additives of the toner, and the film under the image, melts or evaporates away. The iron oxide pigment in the toner remains intact and sinks into the surface of the softening glaze, thus permanently fusing a high quality reproduction of the original image to the ceramic surface. The color of the image results in a brown or sepia tone due to the chemical properties of the iron in the toner.

If a colorful image is desired, additional glaze colors may be applied at any or all of three different times during the process. Glaze colors may be added during the initial glazing of a bisque item, allowing the glaze colors to show through from underneath the positioned image. Glaze colors may also be painted directly on top of the unfired adhered decal before the decal is fired or added on after the decal firing step directly on top of the permanently affixed image and then the item is fired again.

The printing technique of this invention uses standard off-the-shelf black and white laser printers or photocopiers' containing iron oxide based toners and requires no special adjustments or accommodations of the original machines. Standard commercially available film coated water slide decal paper is printed in the conventional manner so the evenness of toner deposit and print quality are always consistent. There are no solvents, retrofitted inks, cover-coats, laminates or other potentially hazardous materials handled by the user.

The method of this invention requires no specialized equipment training beyond the typical steps outlined in the standard operational manuals and instructions available with off-the-shelf equipment.

BRIEF DESCRIPTION OF THE DRAWINGS

The foregoing features of the invention will be more readily understood by reference to the accompanying drawings, in which.

DETAILED DESCRIPTION OF SPECIFIC EMBODIMENTS

Figure 1:
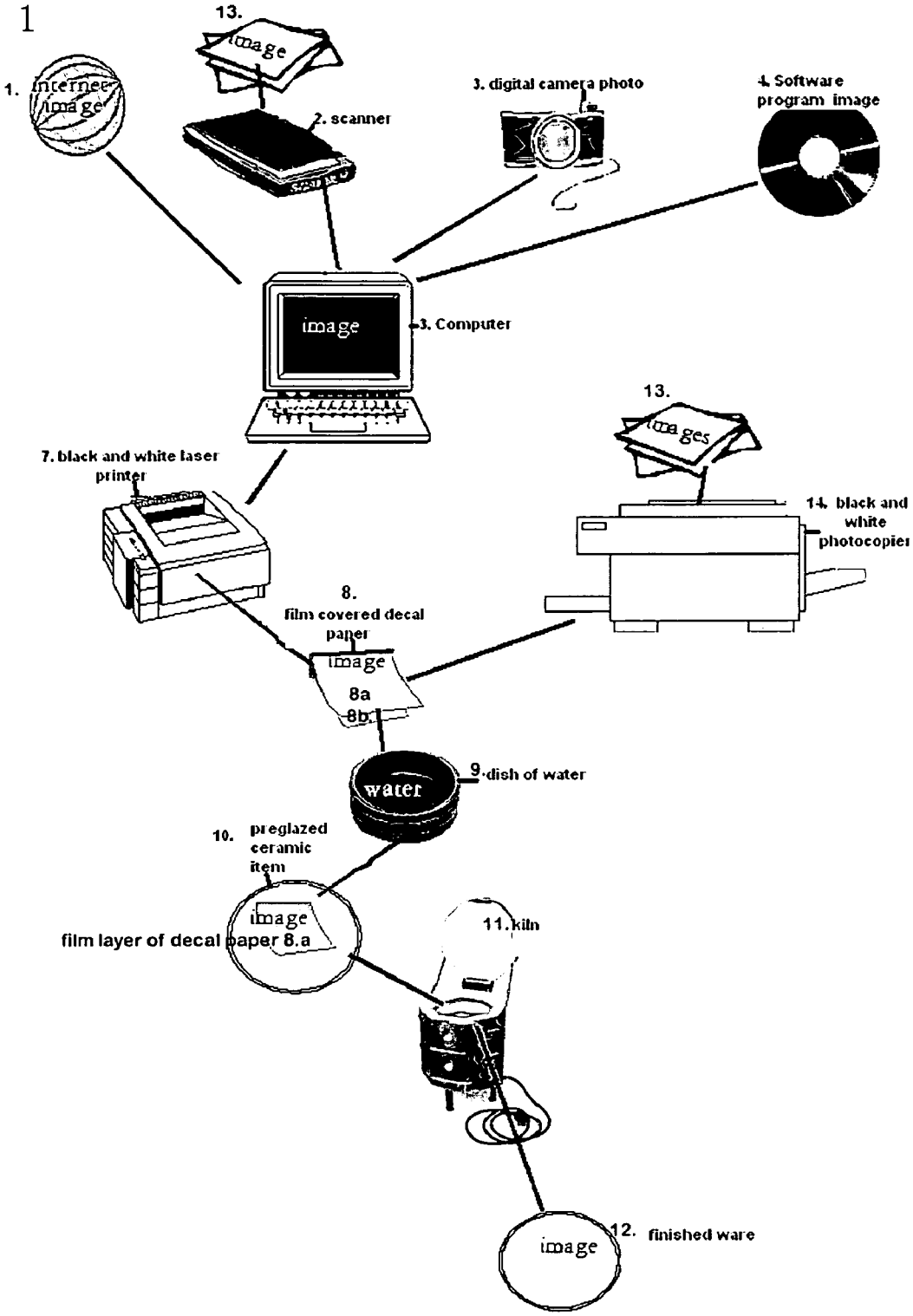
FIG. 1 is a diagram of the technical hardware and software infrastructure for reproducing images and firing those images onto a glossy ceramic substrate in accordance with an embodiment of the present invention.

Definitions, in alphabetical order, as used in this description, including the preceding summary, shall have the meanings indicated unless the context otherwise requires:

1. "Bisque" is an unglazed ceramic object. In the present embodiment of the invention, all bisque objects must first be coated with glaze. prior to the application of an image via a transfer agent.
2. "Cone" is an object of measurement whereby the Cone number refers to a specific kiln firing temperature e.g. Cone 06 equals approximately 1855° Fahrenheit.
3. "Cover-Coat" is a coating or carrier usually consisting of waterproof solvent based lacquers, varnishes, or laminates that are placed directly on top of traditional one layer transfer agents after printing in order to stabilize the image and allow the image to be pulled away intact from the transfer agent prior to adhering it to an object. The present invention has eliminated this requirement and it is used herein only to describe other processes that are restricted to the use of a cover-coat.
4. "Functional" refers to glossy substrates with images that are permanent, oven proof and dishwasher safe.
5. "Glaze" is the coating that becomes a glossy surface after being applied to an object and fired in a kiln. In exemplary embodiments of the present invention, a substrate may be acquired already glazed or, in the example of bisque, it may have a glaze applied to obtain a glossy surface. Glazes are always fired to the glaze manufacturer's recommended temperatures.
6. "Glaze Colors" or "Colored Glazes" are kiln fire able substances which include but are not limited to china paints and ceramic glazes used to add a range of colors to the sepia colored iron oxide print. Color may be added during the initial glazing step of the bisque object, on top of the unfired adhered decal or on top of the fired affixed image and then re-fired. These glazes are always fired to the manufacturer's recommended temperatures.
7. "Glossy Substrate" refers to the surface of an object after it has been coated with a ceramic glaze or is inherently glossy (i.e. glass or commercially available glazed ceramic pieces) and is capable of withstanding the firing temperatures of a kiln. In exemplary embodiments of the present invention, a glossy substrate may be made to have a glossy surface through the application of a glaze prior to applying an image via the transfer agent.
8. "Imaging Device" is any black and white laser printer or photocopier containing toner with a greater-than 30% iron oxide content. A myriad of off-the-shelf imaging devices are readily available in commercially sold printers and photocopiers.
9. "Kiln" is an oven which is capable of reaching temperatures high enough to permanently affix glazes and iron oxide toners to the substrate.
10. "Kiln Fire Able" refers in this invention to any object which is capable of being placed in a ceramic kiln and heated to a temperature of at least 1000° Fahrenheit.
11. "Kiln Firing Temperatures" refer to interior kiln temperatures that are high enough to allow glazes and iron oxide pigments to permanently affix to the selected substrate. The firing temperature of the transfer is often the same or slightly lower than the firing temperature of the original glaze coating of the glossy substrate so that the surface may soften just enough to allow the print to permanently sink in.
12. "Off the Shelf" refers to equipment and supplies that are readily available for purchase and require no customization to use. In the present embodiment of the invention, all supplies, printers, decal papers, glazes and objects may be readily acquired with no special adaptations required.
13. "Traditional One Layer Transfer Agent" is an adhesive coated transfer agent used prior to this invention for most kiln fired transfer applications. Since all transferred images of this type must make direct contact with the chosen substrate, they always required the use of a cover-coat.
14. "Transfer Agent" is the material which transfers a printed image onto a glossy substrate. For example, a photographic image is printed onto a film covered water slide decal paper, the transfer agent, and then adhered to a glossy substrate.

15. "Toner" refers to a printing medium with 30%+ iron oxide content that is found in certain off-the-shelf imaging devices. For example, an image may be printed onto a transfer agent using a standard Hewlett Packard Laserjet 2100 black and white laser printer. Because this printer's toner contains greater-than 30% iron oxide, it is possible to print an image onto film coated water slide decal paper, transfer it to a glossy substrate to be heated in kiln to permanently affix the iron oxide pigment to a glossy substrate.

16. "Film Covered Water Slide Decal Paper" also referred to as "Decal Paper" is the commercial nomenclature for the specific pre-coated film covered transfer papers that act as a transfer agent in this invention. Prior to this invention, this type of decal paper was used exclusively for non kiln fired applications. In exemplary embodiments of the present invention as discussed below, an image is printed from a computer onto a piece of decal paper, for example, Lazertran Fotocal FC Paper or Bel, Inc. Laser Decal Paper via a laser printer. The transfer agent with the image printed on is moistened, separated and adhered to a glossy substrate to be fired in a kiln and thus permanently affixed.

In an exemplary embodiment of the invention an unglazed (bisque) earthenware plate is coated with 3 coats of an opaque white gloss glaze, for example Mayco S2102 white gloss glaze, and allowed to dry. Colored glazes, for example Mayco Stroke and Coat Colors are painted in a design around the edge of plate. If color is desired to show through from underneath the image, colored glazes, for example Mayco Stroke and Coat Colors are painted under where the image will later be placed. The plate is then fired to cone 06 (1855° Fahrenheit) in a standard ceramic kiln. The plate is removed from the kiln when it cools to room temperature.

A digital image is scanned, emailed or downloaded to a computer and placed into any program capable of manipulating and or printing a digital file. The digital image is printed using an HP 2100 laser printer onto a piece of film covered water slide decal paper, for example, Lazertran Fotocal FC Paper or Bel Inc. Laser Decal Paper. The decal paper is trimmed close to the design with a scissors and soaked in a dish of water for one minute until the layers begin to separate. The bottom paper layer is discarded and the top film layer of the decal paper with the image printed on it is positioned onto the surface of the glazed ceramic plate. Air bubbles and water are pushed out by way of a small squeegee or a paper towel rubbed over the surface to adhere the image to the glazed surface.

After the decal dries, glaze colors, for example Mayco Stroke and Coat Colors, may be painted directly on top of the adhered but unfired decal. The ceramic plate is then fired a second time in the kiln to cone 06 (1855° Fahrenheit). During this firing process the decal's film layer, residual adhesive, and the polymer additives of the toner melt and or evaporate leaving just the iron oxide pigment of the print and the color from any colored glazes that were used, permanently affixed to the surface. The original glaze covering of the plate softens during firing allowing the iron oxide pigment and additional colored glazes to sink permanently into the plate's surface.

Colored glazes, for example Mayco Stroke and Coat Colors, may also be added be added after the decal has been firing by painting them directly on top of the permanently affixed fired image. The plate is then fired again to cone 06(1855° F.) fusing this additional color application to the plate's surface.

FIG. 1

FIG. 1 is a diagram of the technical hardware and software required to reproduce images and permanently affix these images onto a glazed ceramic surface with an embodiment of the present invention. An image may be acquired digitally by downloading an image from the internet (1), a software program (5) or a digital device such as a camera (4). Or a selected two dimensional image (13) may be placed in a scanner (2) and manipulated using any computer (3) imaging software program to size and style the design as desired. The digital image is then sent to a black and white laser printer (7) that contains at least 30% iron oxide in its toner. The digital image is printed onto a piece of film covered waterslide decal paper (8), the type which is comprised of two layers; a bottom layer made of adhesive coated paper (8*b*) and the top layer is a thin film (8*a*).

Images may also be acquired by directly copying a selected image (13) onto the decal paper using a photocopier (14). The decal paper with image printed on it is immersed into a dish of tap water (9)to separate the image printed film (8*a*) from the paper layer (8*b*). The paper layer (8*b*) is discarded and the film layer (8*a*) is adhered to an already glazed ceramic piece (10) and fired in a kiln (11). The finished product (12) is a ceramic item with the selected image permanently affixed to its surface.

FIG. 2

Figure 2:
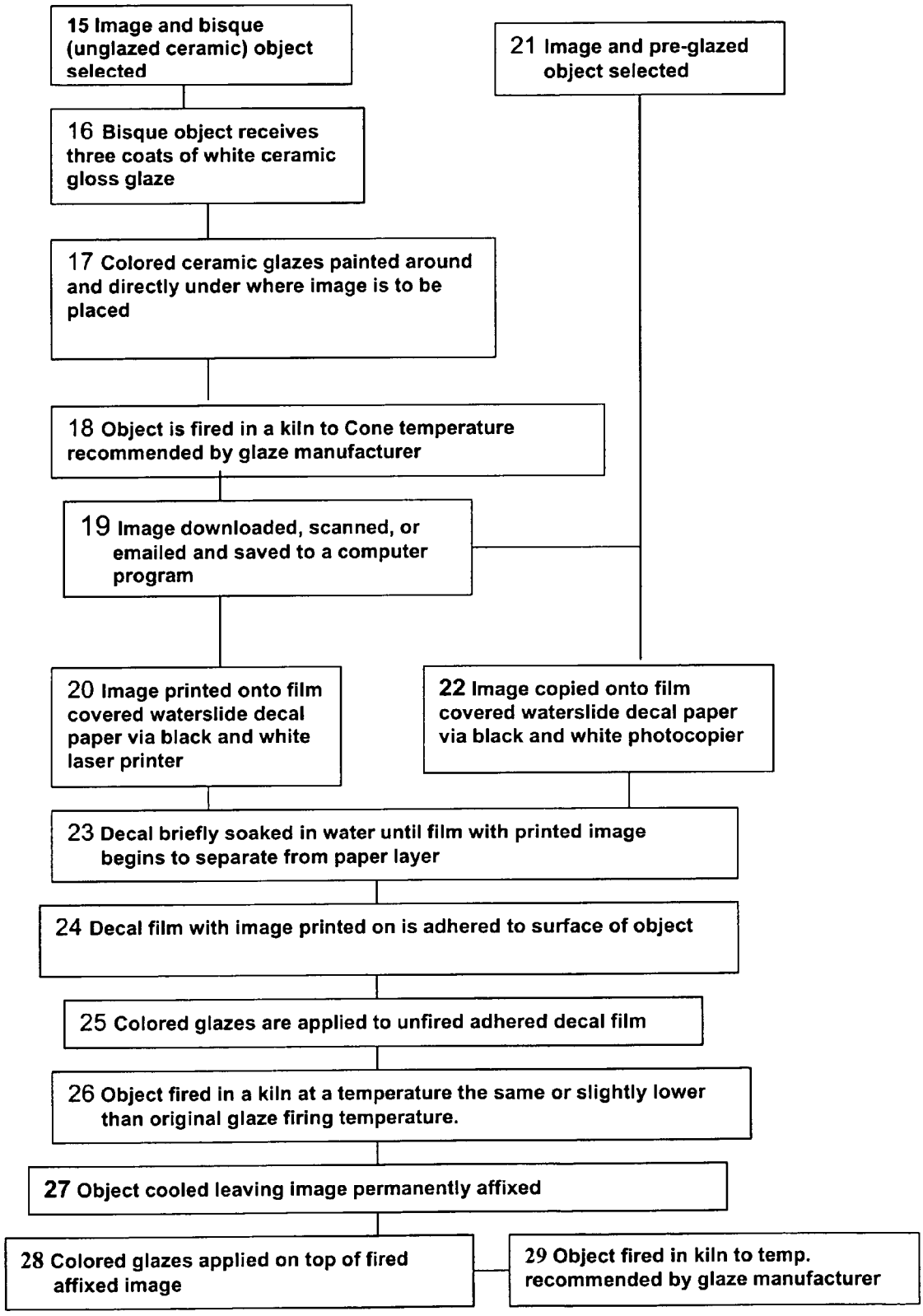
FIG. 2 is a block diagram illustrating the basic steps required to permanently affix an image onto a glossy ceramic substrate, in accordance with an embodiment of the present invention.

FIG. 2 is a block diagram illustrating the basic steps required to reproduce a permanent image on a glossy substrate, in accordance with an embodiment of the present invention including the addition of glaze colors added to the substrate at three separate times. An image and bisque item are selected (15). The bisque item receives three coats of white gloss glaze (16) and is left to dry. Hand painted glaze colors and decorations are added on top of the white glaze both around and under where the image will later be placed. (17) The object is fired in a kiln to the cone temperature recommended by the glaze manufacturer. An object may also be selected that has already been glazed (21). An image is acquired by means of downloading, scanning, emailing and saved to a PC. (19). The image is printed on film covered waterslide decal paper via a black and white laser printer (20). Or an image is directly copied onto the decal paper using a black and white photocopier (22). The decal is briefly soaked in water until the film layer with the printed image begins to separate from the paper sheet. (23) The film layer is adhered to the surface of the object (24). Glaze colors are painted directly on top of adhered but unfired decal film (25). The object is fired in a kiln to a temperature the same or slightly lower than the original glaze firing (26). The object is cooled, leaving an image permanently affixed. (27) The cooled object is again painted with colored glazes (28). The object is again fired in a kiln to the glaze manufacturer's recommended temperature (29).

What is claimed is:

1. A method of permanently transferring an image to a substrate having a glossy surface, including:

providing a sheet of film-covered transfer paper having the image printed on the film side of the transfer paper, wherein the image is printed with an iron-oxide based toner;

transferring the film to the glossy surface; and heating the substrate with the film to a temperature sufficient to evaporate the film and to embed the image into the glossy surface.

2. The method of claim 1, wherein the temperature is at least 1000 degrees Fahrenheit.

3. The method of claim 1, wherein the glossy surface is a glass.

4. The method of claim 1, wherein the glossy surface is a ceramic glaze.

5. The method of claim 1, wherein the substrate is a ceramic.

6. The method of claim 1, wherein the step of providing the transfer paper includes printing the image on the film side of the transfer paper with a laser printing device.

7. The method of claim 1, wherein transferring the film includes wetting the transfer paper and sliding the film onto the glossy surface.

8. A meathod of permanently transferring an image to a substrate having a glossy surface, including:

printing the image onto the film side of a sheet of transfer paper using a laser printing device using an iron-oxide based toner;

transferring the film with the image onto the glossy surface;

heating the substrate with the film to a temperature such that the film evaporates and the image embeds into the glossy surface.

9. The method of claim 8, wherein the glossy surface is one of a glass or a ceramic glaze.

* * * * *